United States Patent [19]

Smith

[11] Patent Number: 4,980,995

[45] Date of Patent: Jan. 1, 1991

[54] METHOD OF FACETING GEMSTONES

[76] Inventor: C. R. Smith, P.O. Box 112, Kennesaw, Ga. 30144

[21] Appl. No.: 243,228

[22] Filed: Sep. 6, 1988

Related U.S. Application Data

[63] Continuation of Ser. No. 40,332, Apr. 20, 1987, abandoned.

[51] Int. Cl.[5] ..... B24B 1/00

[52] U.S. Cl. ..... 51/283 R; 51/326; 51/DIG. 34

[58] Field of Search ..... 51/283 R, 284 R, 318, 51/325, 326, DIG. 34, DIG. 6, 229, 358, 406, 407

[56] References Cited

U.S. PATENT DOCUMENTS

| | | | |
|---|---|---|---|
| 2,024,303 | 12/1935 | Obrig | 51/284 |
| 2,544,940 | 3/1951 | Rittenbusch et al. | 51/DIG. 34 |
| 3,144,737 | 8/1964 | Faas | 51/185 |
| 3,818,641 | 6/1974 | Long | 51/125.5 |
| 3,959,935 | 6/1976 | Stoppacher | 51/395 |
| 4,240,232 | 12/1980 | Chwae | 51/356 |
| 4,258,508 | 3/1981 | Wilson | 51/283 R |
| 4,274,232 | 6/1981 | Wylde | 51/358 |
| 4,733,502 | 3/1988 | Braun | 51/284 R |

FOREIGN PATENT DOCUMENTS

| | | | |
|---|---|---|---|
| 0841690 | 7/1960 | United Kingdom | 51/407 |
| 1321931 | 7/1973 | United Kingdom | 51/DIG. 34 |
| 2021627 | 12/1979 | United Kingdom | 51/DIG. 34 |

*Primary Examiner*—Robert A. Rose

*Attorney, Agent, or Firm*—Kennedy & Kennedy

[57] ABSTRACT

A flat facet is polished with a lap film mounted to the lap last used in prepolishing. In this manner lap surface irregularities and plane angle are maintained. This has been discovered to avoid the creation of scratches in the facet.

12 Claims, 1 Drawing Sheet

METHOD OF FACETING GEMSTONES

This is a continuation of co-pending application Ser. No. 40,332 filed on Apr. 20, 1987 now abandoned.

TECHNICAL FIELD

This invention relates to methods of faceting gemstones.

BACKGROUND OF THE INVENTION

In producing jewels and gems from natural gemstones, or from glass or plastic, flat facets are commonly formed to render the gem aesthetically pleasing. The most popular way of forming flat facets is to mount a stone to a holder, which is termed a dop, of a faceting machine and then to work the surface of the stone with a rotatably driven lap wheel. Lap wheels are typically made of metal such as copper, brass, tin, lead or cast iron, to which an abrasive is added that actually works the stone. These abrasives must be fairly hard, certainly harder than the gemstone to be faceted. Diamond powders and carborundum are abrasives that are commonly employed in early, cutting stages of the faceting process.

In the process of forming facets a series of lap wheels are employed. Initially, a lap wheel having a rough abrasive surface is used to cut the facet. Again, diamond powders and carborundum are commonly used as the abrasive material embedded in the lap wheel working surface. In the cutting phase several laps are used with abrasive powders of increasingly smaller size. As the size of the abrasive decreases the term prepolishing is often used to signify a second phase of the faceting process wherein the facet surface is worked more finely. Again, the size of the abrasive of the lap wheels used continues to decrease until what is termed the polishing phase is entered. Polishing laps used in this final phase commonly employ fine diamond powders, cerium, alumina or other polishing agents.

Softer materials may be employed as the working agent in polishing softer stones such as quartz and tourmalines. Harder stones, as previously stated, require harder abrasive agents such as diamond powders. The size of the abrasive powders or particles decrease from some 60 microns all the way down in some cases to ½ micron or even smaller in average diameter. This is roughly equivalent to a 400 to 50,000 grit range.

During the final polishing stage the faceter devotes a substantial amount of effort in an attempt to achieve an extremely smooth, "optically" flat surface that is free of scratches or blemishes. To the artisan this can be a very time consuming, frustrating and sometimes fruitless effort due to the persistent presence of small surface scratches. Also, polishing lap wheels almost invariably produces a surface that is slightly canted from that produced by the prepolish laps. When this occurs it takes a very substantial time to produce the new plane throughout the entire surface area due to the only weakly abrasive nature of the polishing laps. Alternatively, substantial time is taken in attempts at reorientation.

The quest for perfecting a method of polishing flat facets has been ongoing for years. Many reasons have been hypothesized as to the causes of the difficulty in achieving optically flat, highly reflective and attractive facets. For example, it is frequently thought that polishing laps need to have their lapping surfaces scored to work efficiently. Scoring has been thought to be necessary to avoid a perfectly smooth working surface from which a polishing agent could easily be thrown. It has also been thought necessary to avoid the generation of large amounts of heat and creation of partial vacuums. Other faceters have attributed this problem to lap contamination and to problems of aggregation and flow.

Flat facets have also been polished with the use of polishing slurries applied to smooth lap wheels. Their use, however, has also failed to eliminate the just described problems. The perceived problems of aggregation and flow have persisted with this which has been attributable to the tendency for polishing agents to accumulate in front of the leading edge of the facet being polished. In attempts to remedy aggregation and flow problems with the use of slurry type polishing agents, the consistency of the polishing slurry has been reduced and the direction of lap movement across the facet has been changed.

Whether polishing is done with a polishing lap or with polishing slurries, the formation of smooth, highly polished and reflective flat facets has remained a very difficult task. For a more detailed description of these problems and of the techniques employed in attempting to overcome them, reference may be had to the book by Glenn Vargas titled *Faceting for for Amateurs* which is well known to hobbyists and to professional faceters alike.

SUMMARY OF THE INVENTION

A solution to the problem has now been discovered wherein a method of faceting gemstones comprises the steps of sequentially cutting a stone with a coarse grit lap to form a flat facet, prepolishing the flat facet with medium and/or fine grit prepolishing laps, and then polishing the flat facet with a lap film mounted flushly upon the prepolishing lap last employed during prepolishing.

In another form of the invention a flat facet is cut on a gemstone and prepolished with a series of rotating lap wheels that bear abrasives of increasingly fine grit. The facet is polished by contacting the facet with a lap film held in intimate contact with the working surface of the lap wheel last used in prepolishing.

In yet another form of the invention a method of faceting gemstones comprising the steps of sequentially cutting the stone to form a generally flat facet, prepolishing the generally flat facet with a prepolishing lap wheel, and polishing the flat facet with a lap film mounted flushly upon the lap wheel that bears powders or particles of a selected size range. The film is then removed from the lap wheel and the flat facet polished with another lap film mounted flushly upon the same lap wheel that bears powders or particles of a smaller size than those born by the lap film first used.

DETAILED DESCRIPTION

Figure 1:
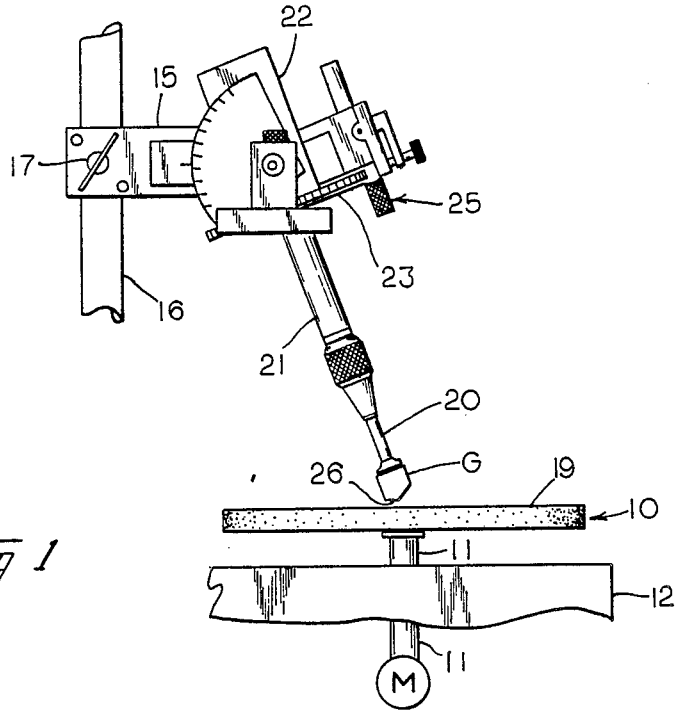
FIG. 1 is a side view of the portion of a faceting machine shown with a gemstone mounted thereto in the process of being faceted.

With reference next to the drawing, there is shown in FIG. 1 a conventional gem faceting machine which comprises a lap wheel 10, which often is referred to simply as a lap, that is mounted atop a vertically oriented drive shaft 11 which is driven by an electric motor M located beneath a table 12. In some cases the lap 10 is mounted atop a base lap wheel that is mounted upon the drive shaft 11 and secured thereto by a nut or bolt which protrudes centrally above the upper surface of the lap. In other cases, as here, the mounting is effected exclusively on the bottom of the lap as by being threaded into a hole in the bottom. Adjacent to the motor driven lap wheel is located an elevator 15 that is movably mounted upon an upright track 16. The elevator may be held fixedly to the track at various elevations by means of a set screw 17. With some faceting machines the upright member 16 is threaded as a screw while with others it is not.

The elevator supports a dop stick 20 which is mounted to the bottom of a shaft 21 that in turn is pivotably mounted to a tiltable frame 22. An index gear 23 is mounted to the shaft 21 for use in adjusting the shaft and locking it in various angular positions about the shaft axis for determining angular locations of the facets of a gemstone G mounted to the bottom of the dop stick 20. A locking lever 25 is coupled with the gear 23 for securing it, and thus the gemstone G, in a fixed angular position about the axis of the shaft 21. Thus with this faceting machine, which is quite conventional, a faceter may manipulate a gemstone G in a precise manner by bringing it into contact with the lap 10 and moving it upon its surface in forming a flat facet 26 located in the drawing just above and parallel to the upper surface 19 of lap 10.

As previously explained, flat facets are formed on gemstones with the use of a series of laps that bear abrasive powders or particles of increasingly small size. It has now been discovered that the real reason for frustrations long encountered by faceters in achieving very smooth and highly polished, optically flat facets in any reasonable amount of time has been primarily due to the inability to match the planar surface worked by the lap last used in fine polishing with that of the lap previously used in an earlier polishing or prepolishing stage. Even with the high degree of flatness to which polishing laps are are manufactured, it is extremely difficult to substitute one lap for the next lap without some change in the contour of the working surface of the polishing lap. Even where the surfaces are flat initially, there can be a very slight misalignment or relative canting creating merely by the process of mounting inofitself. In other words, mere tightening the screw in securing the last polishing lap to the motor driven shaft can effect a slight tilting or canting relative to the orientation of the previously used lap where the same motor drip set-up is used. Moreover, once a polishing or prepolishing lap has actually been worked a slight, almost imperceptible alteration in the contour of its working surface is effected by the working of the gemstones.

Applicant now has discovered that by maintaining the just described irregularities, however miniscule, a final polishing of flat facets may be achieved in a highly improved manner. This is to say that an optically flat, unblemished and unscratched facet may be achieved with virtually an order of magnitude reduction in time heretofore experienced by both the typical amateur and the professional faceter. This is particularly accomplished by the means of utilizing a lap film that is placed in intimate contact with the last polishing or prepolishing lap wheel employed and then using the working surface of that film for final polishing. In doing this irregularities in contour are maintained. In addition, a new plane is not established, however slightly canted from the prior plane, which would create the need for a tremendous amount of time to work with a fine polishing lap to replane completely across the facet face. Scratches and blemishes which are now been appreciated to have formed by such mismatch, no longer normally make their rather mysterious appearance to the frustration of the faceter.

Figure 2:
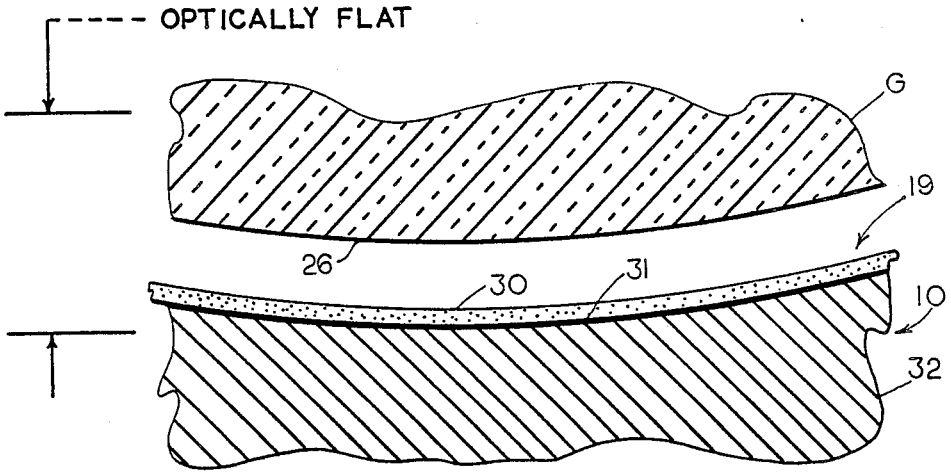
FIG. 2 is a greatly enlarged, fragmentary view of a portion of a gemstone being faceted for purposes of illustrating a problem and solution provided by the present invention.

FIG. 2 illustrates this solution. It should be understood that this figure depicts one very small segment of a lap wheel and facet which has been extremely enlarged for purposes of illustration. Here, it is seen that lap wheel 10 has a lap film 30 that provides its working surface 19. The film is mounted in intimate, flush contact atop the surface 31 of a lap wheel 32. In FIG. 2 it is seen that this tiny fragment of the lap is shown spaced along its convex surface from the concave surface fragment of surface 26 of a gemstone. Such a miniscule concave portion of the lap wheel may well have been caused by a constant traversing of a stone by the faceter in moving the stone back and forth from the outer edge towards the center of the lap wheel during prepolishing or in an early polishing stage. In any case, it is seen that by applying the film 30 to the surface 31 of the last used lap 32 the surface irregularity is maintained. Again, this curvature is tremendously exaggerated, as shown by the comparison of the range defined as optically flat. As a result the slight irregularity of the flat facet face is maintained. As a result, a scratch mark is not formed by a slight change in contour as would occur, for example, were a planar polishing surface next substituted for the convex one shown. Furthermore, a change in plane all across the facet is not created which the faceter would have to rework completely across the facet surface in forming a new plane or consume a large amount of time in attempting to reorient to the new plane.

Lap films have heretofore existed as disclosed in U.S. Pat. No. 3,916,584. For example, an imperial diamond lapping film disc is commercially sold by the 3M Corporation for the purpose of polishing video heads. Preferably, the lap film is formed of plastic which has embedded therein diamond powders less than 60 microns in size. The film may be mounted readily to the surface of a last used lap by wetting the surface as with water which is commonly dripped upon the surface of laps anyway as they are worked. By wetting the lap surface the film when mounted thereon has been found to make intimate contact and to be held firmly thereto as the lap is rotated and a gemstone is moved back and forth along its surface in polishing. This film may be applied to prepolishing laps having 600 or higher grit size which is to say some 60 or smaller micron size. However, it has been found preferable to mount the film atop a polishing grade lap wheel having polishing particles or powders of 22 micron or less size.

There are, of course, tradeoffs to be had in this selection. For example, smaller micron size powders may provide smoother surface but at the expense of time. Furthermore, the type particles will depend upon the nature of the stone being cut with diamond powders being useable in most cases, but certainly preferable for cutting harder stones. With coarser grit laps it has been found that the lap film does not adhere well even with the use of a water wetting agent in that the film tends to slip and roll up under the dop. The use of a tacky back or adhesive backed film upon rougher grit laps is possible. However, they are difficult to peel off. Also, with the coarser grits the working surface of the film may be recontoured as tiny film protrusions.

A series of lap films may also be used. For one example, the stone may be prepolished with a 600 grit lap wheel and then sequentially polished with a 1,200 grit lap film, a 3,000 grit lap film and finally fine polished with a 50,000 grit film. With this procedure the same prepolishing lap wheel is, of course, used with each of the lap films with the prior lap film removed each time from the working surface of the prepolish lap wheel.

It thus is seen that a new method of polishing flat facets is provided which overcomes problems of the methods of the prior art. It should be understood, however, that the just described embodiments of the inventive method merely illustrate principles of the invention in selected, preferred forms. Many modifications, additions and deletions may be made thereto without departure from the spirit and scope of the invention as set forth in the following claims.

I claim:

1. A method of faceting gemstones comprising the steps of sequentially:

(a) cutting the stone with a coarse grit lap to form a a flat facet;

(b) polishing the flat facet with a medium or finer grit polishing or prepolishing lap; and (c) polishing the flat facet with a lap film of a thickness less than 10 mils mounted flushly upon the lap employed in step (b) in the absence of a slurry.

2. The faceting method of claim 1 wherein step (b) the flat facet is prepolished with a fine grit lap having abrasive powder or particles of a size smaller than 45 microns.

3. The faceting method of claim 2 wherein step (b) the flat facet is polished with a fine grit lap having abrasive powder of a size generally within the range of 8 to 30 microns.

4. The faceting method of claim 1 wherein prior to step (c) the polishing lap employed in step (b) is wetted with a wetting agent and the film applied to the wetted lap and held flushly thereto by the wetting agent.

5. The faceting method of claim 1 wherein step (c) the flat facet is polished with a lap film having polishing powder embedded in a plastic film substrate.

6. The faceting method of claim 1 wherein step (c) the flat facet is polished with a plastic film in which diamond powders are embedded.

7. In the process of faceting a gemstone wherein a flat facet is cut and prepolished with a series of rotating lap wheels that bear abrasives of increasingly fine grit size, the improvement comprising the step of polishing the facet by contacting the facet in the absence of a slurry with a lap film of a thickness less than 10 mils held in intimate contact upon the working surface of the lap wheel last used in prepolishing the facet.

8. The improvement of claim 7 wherein the facet is contacted with a plastic lap film in which diamond powders are embedded.

9. The improvement of claim 7 wherein the facet is contacted with a lap film held in intimate contact with the working surface of a lap wheel having abrasive powders or particles of a size smaller than 60 microns.

10. The improvement of claim 7 wherein the facet is contacted with a lap film held in intimate contact with the working surface of a lap wheel having abrasive powders or particles of a size within the range of 8 to 30 microns.

11. The improvement of claim 7 wherein the facet is polished with a lap film having bearing powders of a selected size range which is then removed from the lap wheel, wherein the facet is then fine polished with a second lap film bearing powder of a size range finer than that of the selected size range which second lap film is held in intimate contact upon the working surface of the lap wheel last used in prepolishing the facet.

12. A method of faceting gemstones comprising the steps of sequentially:

(a) cutting the stone to form a generally flat facet;

(b) prepolishing the generally flat facet with a prepolishing lap wheel;

(c) polishing the flat facet with a lap film of a thickness less than 10 mils mounted flushly upon the lap wheel employed in step (b) that bears powders or particles of a selected size and range;

(d) removing the film used in step (c) from the lap wheel; and (e) polishing the flat facet by contacting the facet in the absence of a slurry with a lap film of a thickness less than 10 mils mounted flushly upon the lap wheel employed in step (b) that bears smaller size powders or particles than those borne by the lap film employed in step (c).

* * * * *